US008002242B2

(12) United States Patent
Lu

(10) Patent No.: US 8,002,242 B2
(45) Date of Patent: Aug. 23, 2011

(54) EXTENSION ROD UNIT

(76) Inventor: Jung-Wen Lu, Dali (TW)

( * ) Notice: Subject to any disclaimer, the term of this patent is extended or adjusted under 35 U.S.C. 154(b) by 457 days.

(21) Appl. No.: 12/292,492

(22) Filed: Nov. 20, 2008

(65) Prior Publication Data

US 2010/0123109 A1 May 20, 2010

(51) Int. Cl.
*B66F 1/04* (2006.01)

(52) U.S. Cl. ..... 254/108

(58) Field of Classification Search ..... 254/108–11, 254/112, 134; 410/151
See application file for complete search history.

(56) References Cited

U.S. PATENT DOCUMENTS 2,474,045 A * 6/1949 Freeland ..... 254/385
2,632,629 A * 3/1953 Monckmeier ..... 254/264
3,049,328 A * 8/1962 Bishop ..... 52/632
4,434,970 A * 3/1984 Boland et al. ..... 254/108
5,813,647 A * 9/1998 Chen ..... 248/354.7
5,890,856 A * 4/1999 Huang ..... 410/151
6,210,090 B1 * 4/2001 Wyse ..... 410/151
7,316,387 B2 * 1/2008 Lu ..... 254/108
7,374,380 B2 * 5/2008 Huang ..... 410/151
2002/0153517 A1 * 10/2002 Huang ..... 254/223
2005/0087730 A1 * 4/2005 Hu ..... 254/223
* cited by examiner

*Primary Examiner* — Kevin C. Sirmons
*Assistant Examiner* — Jeremy Samuels
(74) *Attorney, Agent, or Firm* — Rosenberg, Klein & Lee

(57) ABSTRACT

An extension rod unit includes an outer tube with an inner tube retractably inserted thereto and a ratchet unit is connected to the open top of the outer tube. The ratchet unit includes a connection member and a lever. The connection member includes two side panels and each have a first lug extending therefrom. The lever has two second lugs and the shaft extends through the first and second lugs so as to pivotably connect the lever to the connection member. Two ratchet gears are located between two sets of first and second lugs. A slot is defined axially through the shaft. A driving member has a first end fixed to the fixing part and a second of the driving member extends through the slot of the shaft and is located beyond the outer tube. By pivoting the lever, the inner tube can be moved relative to the outer tube.

6 Claims, 13 Drawing Sheets

EXTENSION ROD UNIT

FIELD OF THE INVENTION

The present invention relates to an extension rod unit, and more particularly, to an extension rod unit which can be micro-adjusted.

BACKGROUND OF THE INVENTION

A conventional extension rod unit 8 is shown in FIGS. 12 and 13, and generally includes an inner tube 81 and an outer tube 82 into which the inner tube 81 is retractably inserted, two support boards 83 are connected to two ends of the extension rod unit 8. A connection member 9 includes two lugs 91 extending from two ends thereof and the connection member 9 is fixedly mounted to the open end of the outer tube 82 by narrowing the distance between the two lugs 91.

The inner tube 81 includes multiple positioning holes 811 defined therein and a lever 94 is pivotably connected to the connection member 9. An engaging member 92 is located within the lever 94 and biased by a spring, the engaging member 92 includes teeth 93 which are removably engaged with the positioning holes 811 in the inner tube 81. The inner tube 81 is pushed upward by pivoting the lever 94 downward. A positioning member 95 is located in the connection member 9 and includes a pawl 951 which has an inclined surface, the pawl 951 is removably engaged with one of the positioning holes 811 to keep the inner tube 81 from sliding downward relative to the outer tube 82. A torsion spring 96 is used to keep positioning member 95 at the position such that the pawl 951 is always engaged with one of the positioning holes 811.

It is understood that the positioning holes 811 bear a significant stress when the pawl 951 is engaged therewith to prevent the inner tube 81 from collapsing downward, especially when a load is applied to the support board 83. However, the positioning holes 811 are not applied with heat treatment which may cause deformation of the positioning holes 811. Therefore, the inner tube 81 is weak and has a short term of use. Besides, the pawl 951 bears significant stress and is easily broken.

Furthermore, the movement of the inner tube 81 can only be adjusted by the distance between the positioning holes 811, so that when securing boxes for example, there will be small gaps between the boxes because the inner tube 81 cannot be micro-adjusted. The gaps cause impact between the boxes which may even drop during transportation.

The present invention intends to provide an extension rod unit wherein the inner tube can be micro-adjusted relative to the outer tube.

SUMMARY OF THE INVENTION

The present invention relates to an extension rod unit which comprises an outer tube and an inner tube which has a first end retractably inserted into an open top of the outer tube. A space is defined between the outer and inner tubes and a fixing part is located on the first end of the inner tube. Two support boards are connected to a second end of the inner tube and a lower end of the outer tube.

A ratchet unit is connected to the open top of the outer tube and a shaft extends through the connection member and an end of a lever. The connection member includes two side panels and each have a first lug extending therefrom. The lever has two second lugs and the shaft extends through the first and second lugs so as to pivotably connect the lever to the connection member. Two ratchet gears are located between two sets of first and second lugs. A slot is defined axially through the shaft. A first engaging plate is located in the connection member and biased by a first spring so as to be engaged with the ratchet gears. Each of the two first lugs includes a recess and a notch. The lever includes a second engaging plate movably connected thereto and the second engaging plate is biased by a second spring so as to be engaged with the ratchet gears. The second lugs each include a push part. A driving member has a first end fixed to the fixing part and a second of the driving member extends through the slot of the shaft and is located beyond the outer tube.

When the second engaging plate is positioned in the recesses of the two first lugs of the connection member, the first and second engaging plates both are engaged with the ratchet gears, such that the inner tube is moved in a direction away from the outer tube by pivoting the lever. When the second engaging plate is positioned in the notches of the two first lugs of the connection member, the first engaging plate is disengaged from the ratchet gears by the push parts so that the first and second engaging plates both are disengaged from the ratchet gears, the inner tube is freely moved relative to the outer tube.

The primary object of the present invention is to provide an extension rod unit wherein the inner tube can be micro-adjusted so as to meet different types of use.

Another object of the present invention is to provide an extension rod unit wherein the inner tube does not include positioning holes so that the inner tube can be applied with heat treatment to increase the structural strength thereof. The inner tube is not supported by a single pawl as disclosed in the conventional extension rod unit, so that the inner tube can have a longer life of use.

Yet another object of the present invention is to provide an extension rod unit wherein the driving member can be a strip which includes a tension so as to absorb shaking force during transportation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
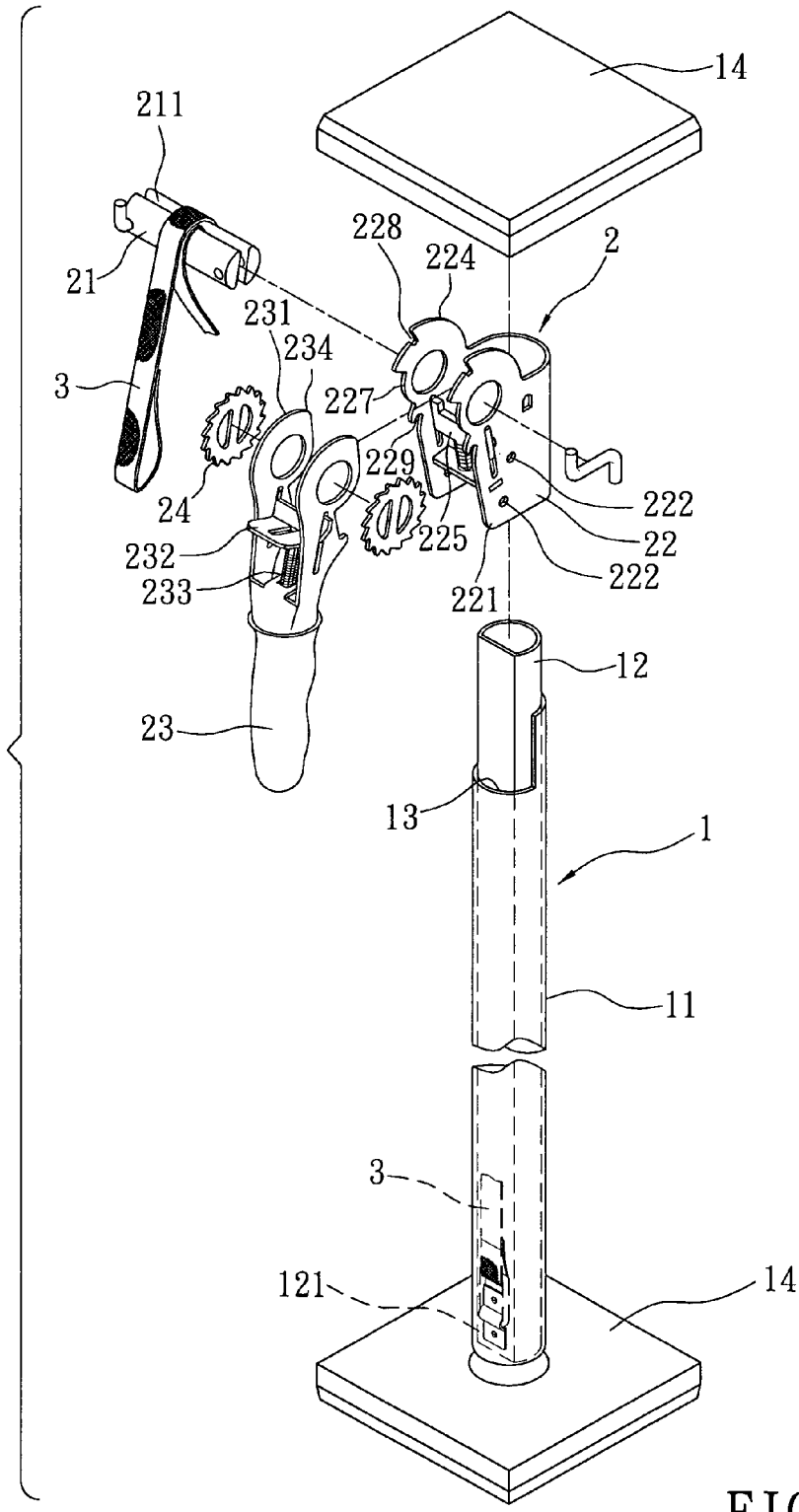
FIG. 1 is an exploded view to show the extension rod unit of the present invention.
Figure 2:
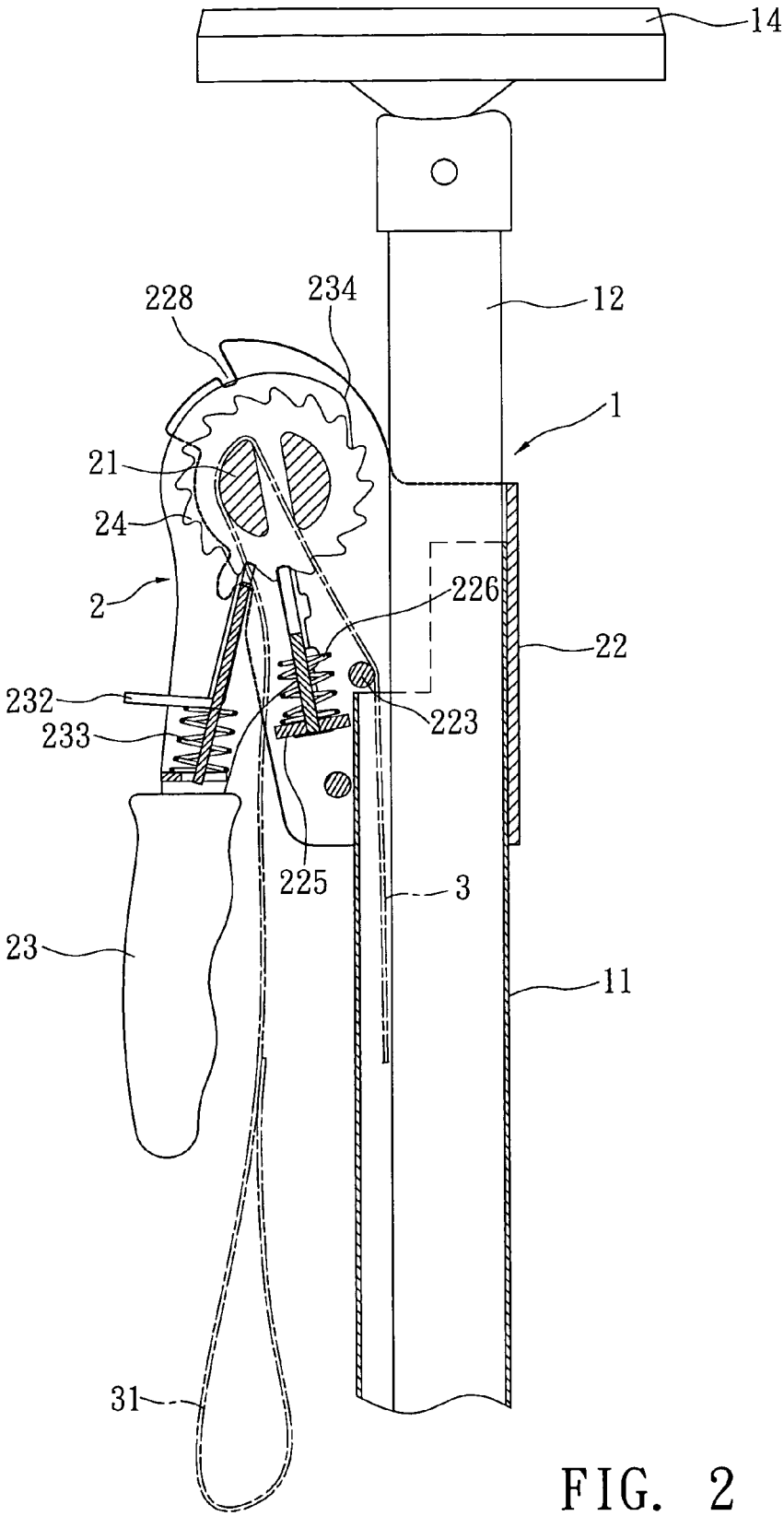
FIG. 2 is a partial cross sectional view to show that the second engaging plate is engaged with the recess of the first lugs.
Figure 3:
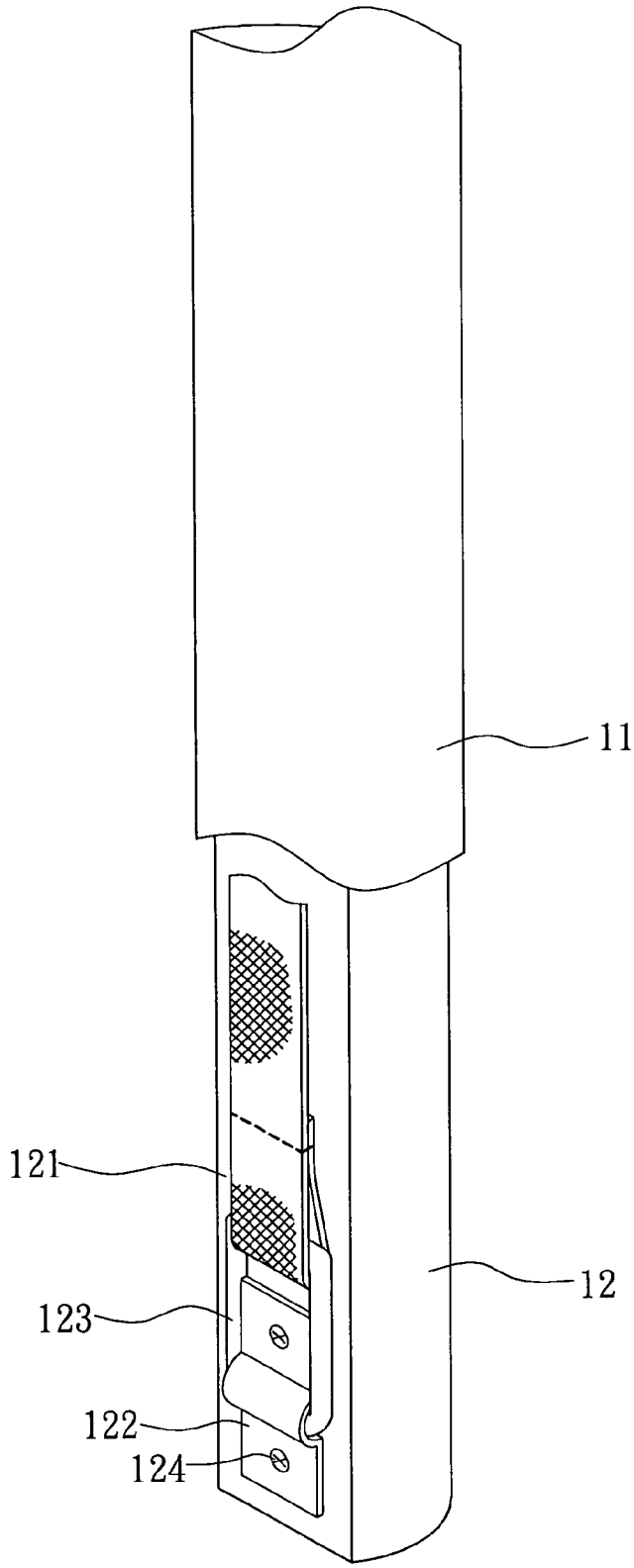
FIG. 3 is a perspective view to show the fixing part of the driving member of the present invention.

Referring to FIGS. 1 to 4, the extension rod unit 1 of the present invention comprises an outer tube 11 and an inner tube 12 which has a first end retractably inserted into an open top of the outer tube 11. A space 13 is defined between the outer and inner tubes 11, 12. A fixing part 121 is located on the first end of the inner tube 12 and located within the outer tube 11. The fixing part 121 includes a fixing plate 122 which is fixed to the inner tube 12 by bolts 124 as shown in FIG. 3 and a ring 123 is connected to the fixing plate 122. Two support boards 14 are connected to a second end of the inner tube 12 and a lower end of the outer tube 11.

A ratchet unit 2 includes a connection member 22 which is connected to the open top of the outer tube 11. The connection member 22 includes two side panels 221 and each of the side panels 221 includes multiple holes 222 and bolts 223 extend through the holes 222 to connect the connection member 22 to the outer tube 11. Each side panel 22 further has a first lug 224 extending therefrom. A shaft 21 extends through the connection member 22 and an end of a lever 23. The lever 23 has two second lugs 231 and the shaft 21 extends through the first and second lugs 224, 231 so as to pivotably connect the lever 23 to the connection member 22. Two ratchet gears 24 are located between two sets of first and second lugs 224, 231. In this embodiment, the teeth of the ratchet gears 24 curve counter clockwise. A slot 211 is defined axially through the shaft 21. A first engaging plate 225 is located in the connection member 22 and biased by a first spring 226 so as to be engaged with the ratchet gears 24. Each of the two first lugs 224 includes a recess 227 and a notch 228. In this embodiment, the first lugs 224 further have a positioning concavity 229 for positioning of the lever 23.

The lever 23 includes a second engaging plate 232 movably connected thereto and the second engaging plate 232 is biased by a second spring 233 so as to be engaged with the ratchet gears 24. The second lugs 231 each include a push part 234 which is in a form of a cam-shaped part.

A driving member 3 has a first end connected to the ring 123 of the fixing part 121 and a second of the driving member 3 extends through the slot 211 of the shaft 21 and is located beyond the outer tube 11. A loop 31 is formed at the second end of the driving member 3. It is noted that the driving member 3 can be an elongate strip, a steel rope, a fabric rope or a cable.

Figure 4:
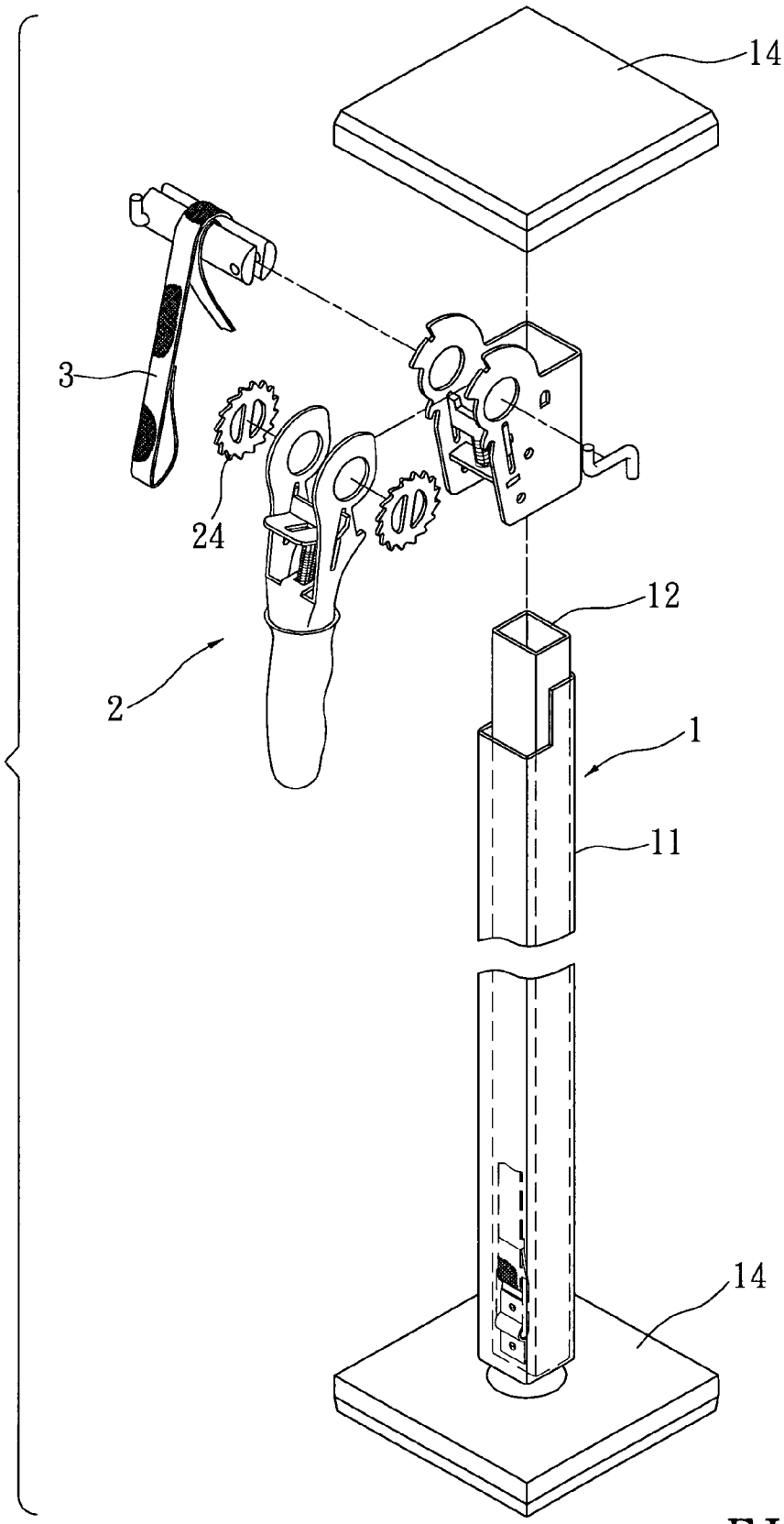
FIG. 4 is an exploded view to show the extension rod unit of the present invention, wherein the inner and outer tubes have rectangular cross section.

In this embodiment, the outer tube 11 has a substantially circular cross section and the inner tube 12 has a substantially semi-circular cross section. The outer tube 11 and the inner tube 12 each may have other shape of cross section such as triangular cross section, square cross section, or any polygonal cross section. As shown in FIG. 4, the outer tube 11 has a substantially rectangular cross section.

Figure 5:
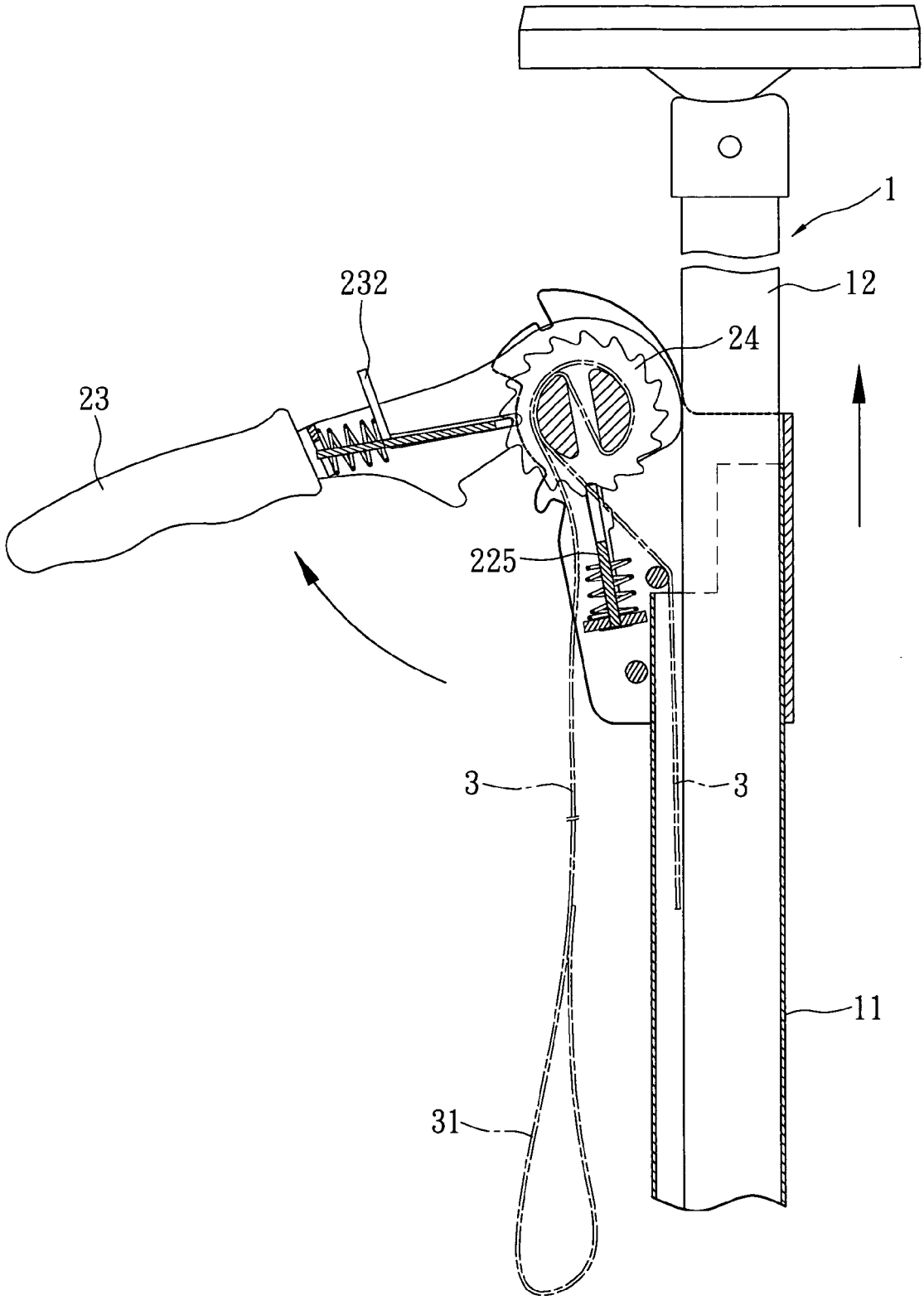
FIG. 5 shows that the inner tube is moved upward by pivoting the lever upward.

As shown in FIG. 5, when the user wants to extend the inner tube 12, the second engaging plate 232 is positioned in the recesses 227 of the two first lugs 224 of the connection member 22. The first and second engaging plates 225, 232 both are engaged with the ratchet gears 24. The first engaging plate 225 prevents the ratchet gears 24 from rotating reversely. The lever 23 is then pivoted upward, the second engaging plates 232 drives the ratchet gears 24 which rotates the shaft 21 so that the driving member 3 is pulled to pull the inner tube 12 in a direction away from the outer tube 11.

Figure 6:
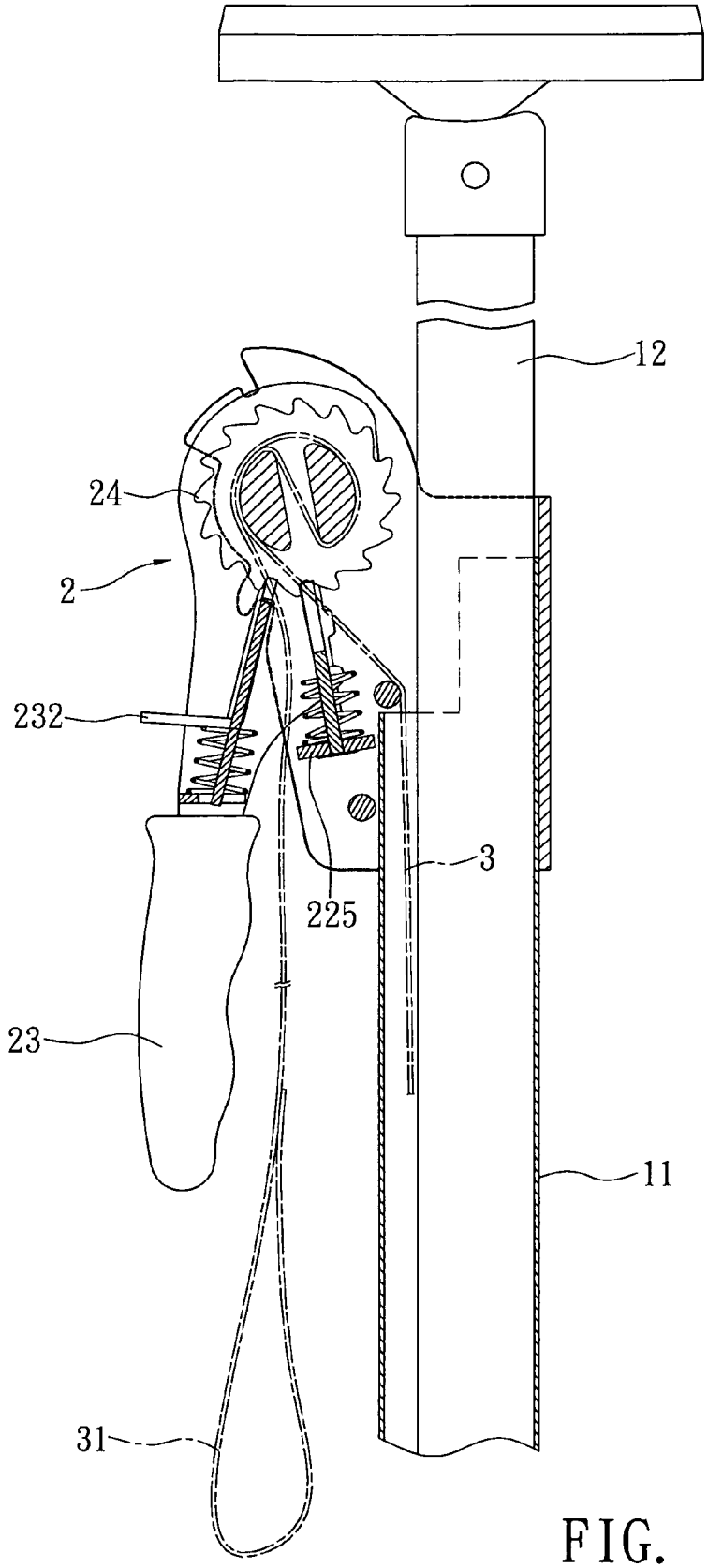
FIG. 6 shows the inner tube is positioned relative to the outer tube.

When the inner tube 12 is moved to a desired height, the second engaging plate 232 is shifted to be engaged with the positioning concavities 229 as shown in FIG. 6, so that the lever 23 is substantially parallel to the inner tube 12 and the ratchet gears 24 are stopped by the first engaging plate 225 even if the lever 23 is unintentionally touched.

Figure 7:
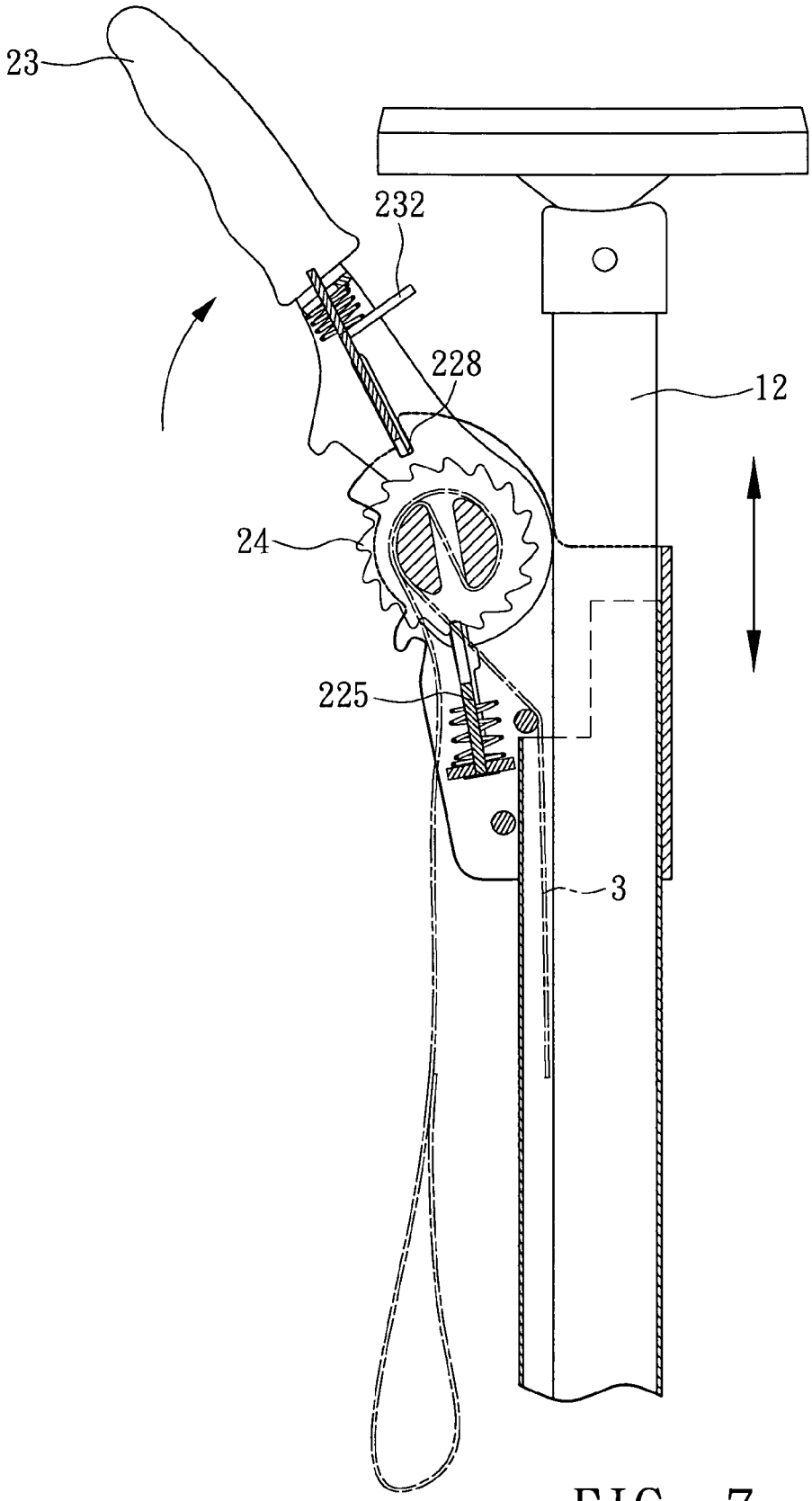
FIG. 7 shows the inner tube is freely moved relative to the outer tube when the second engaging plate is engaged with the notches.
Figure 8:
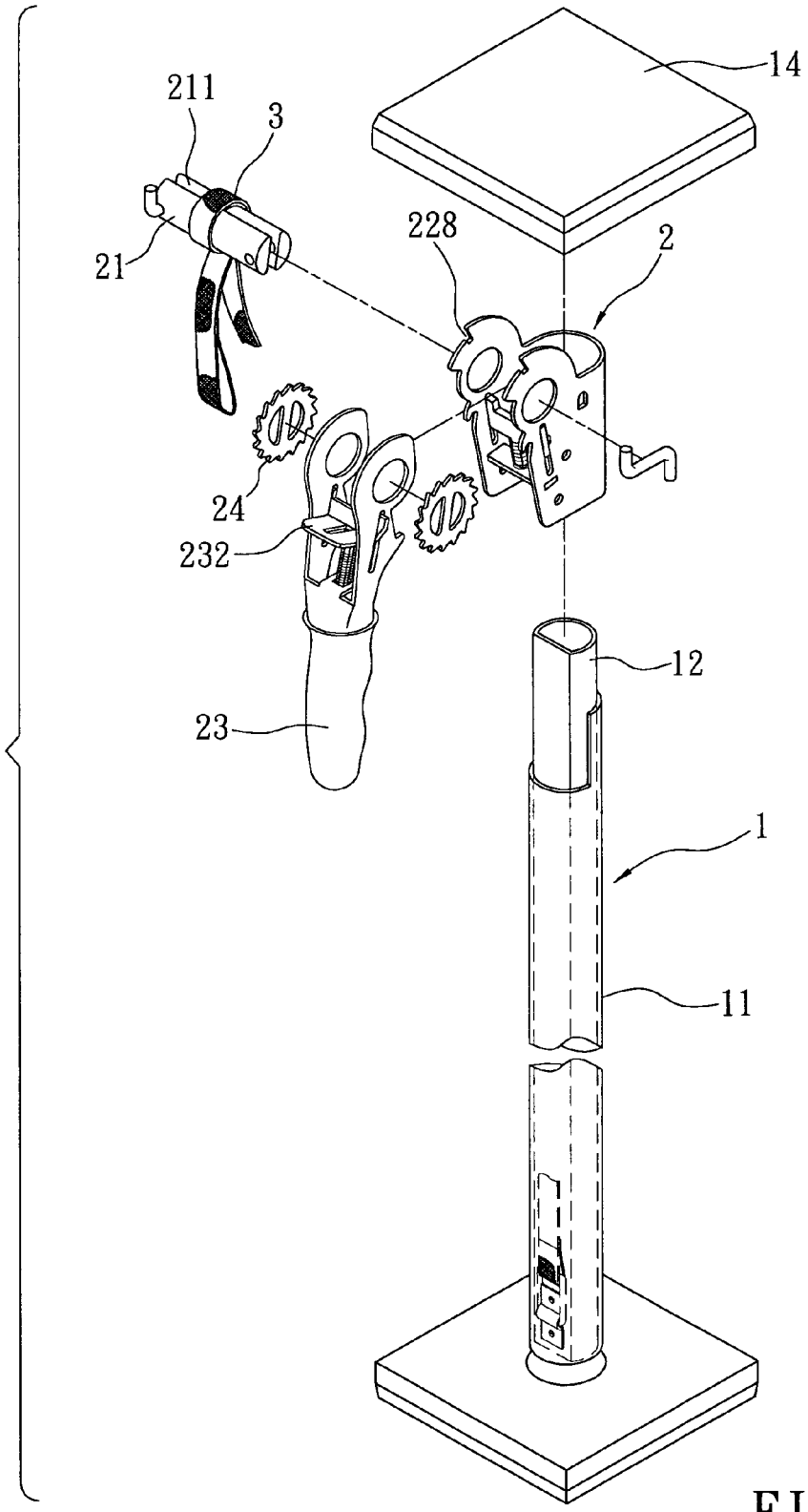
FIG. 8 is an exploded view to show the other embodiment of the extension rod unit of the present invention, wherein the teeth of the ratchet gears curve clockwise.
Figure 9:
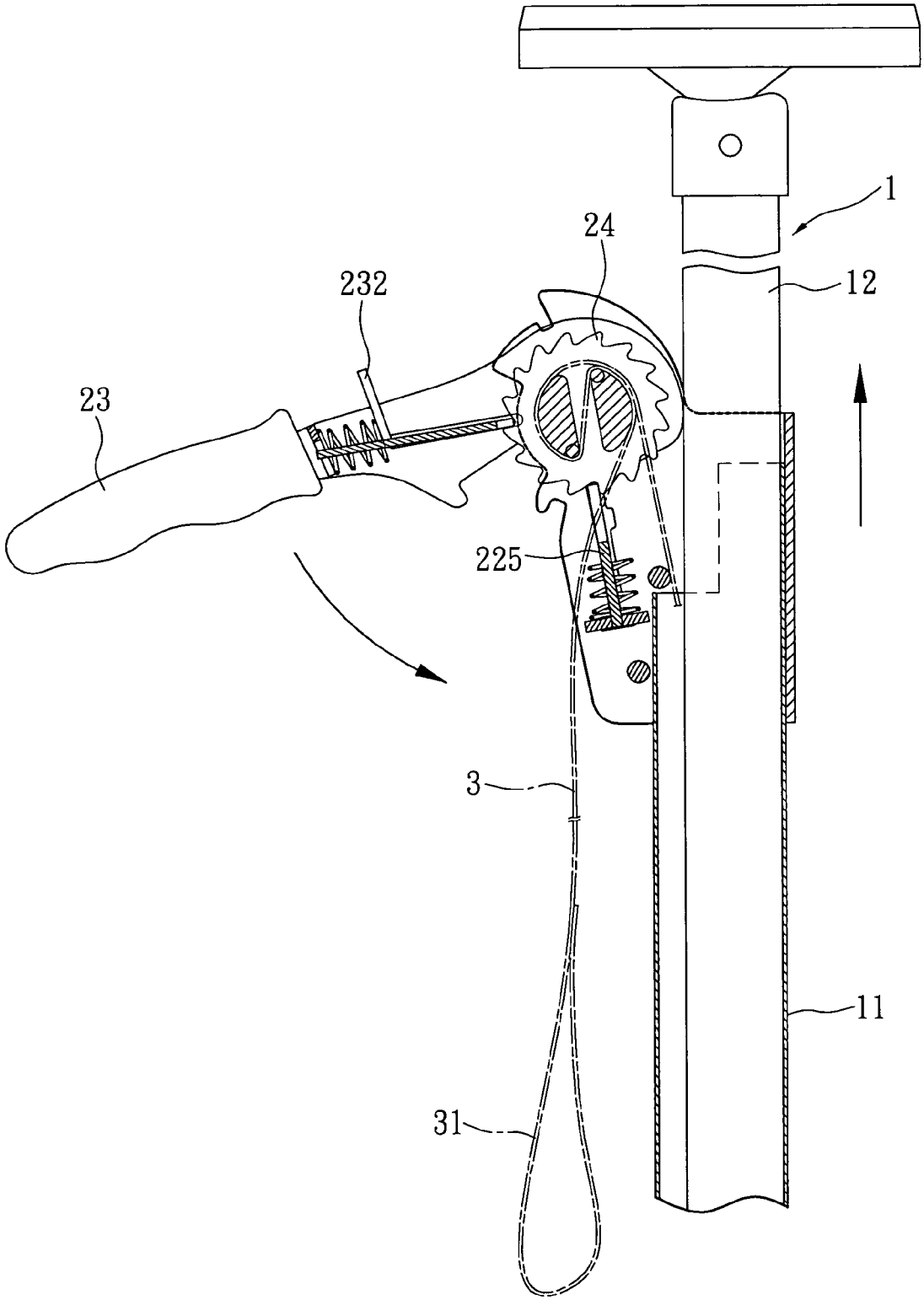
FIG. 9 shows that the inner tube is moved upward by pivoting the lever downward.
Figure 10:
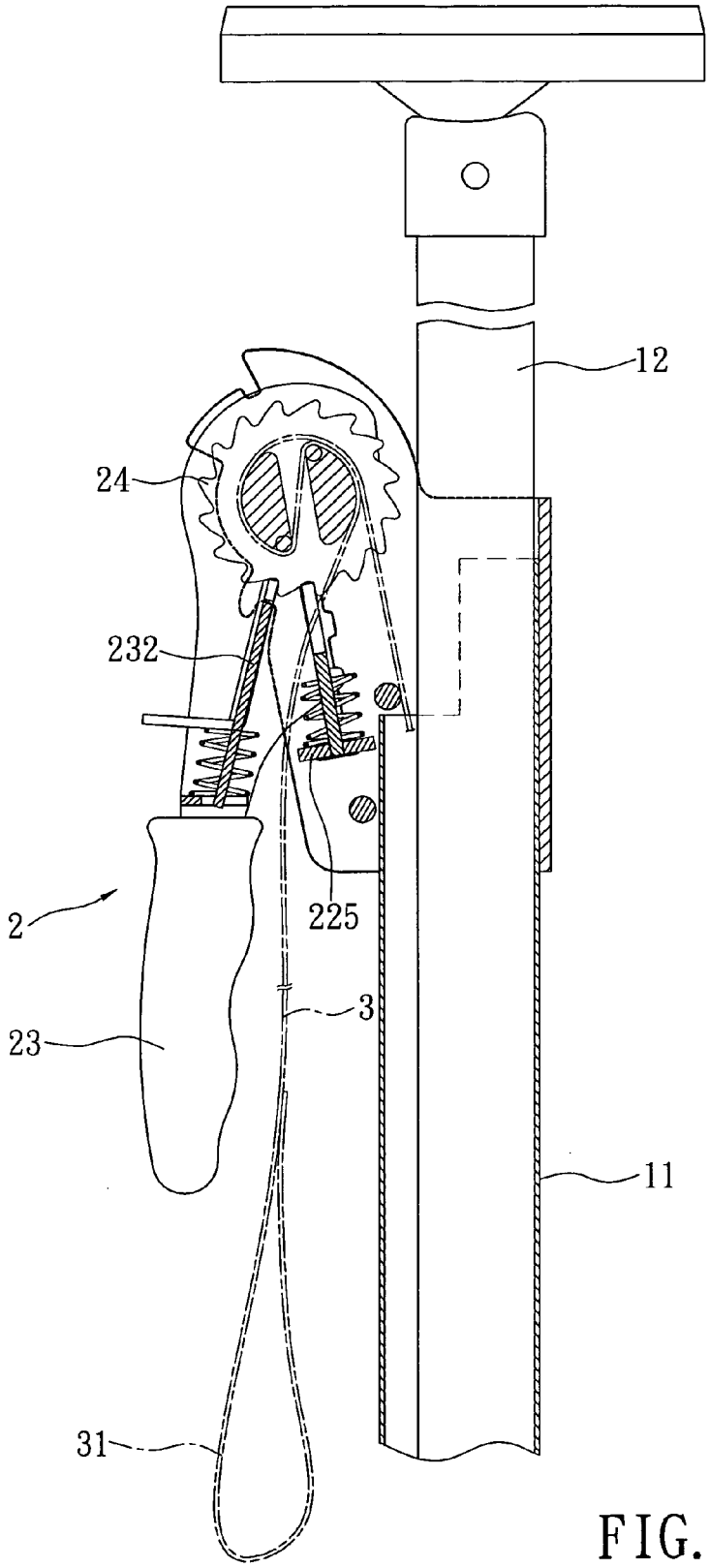
FIG. 10 shows the inner tube is positioned relative to the outer tube for the embodiment of FIG. 8.
Figure 11:
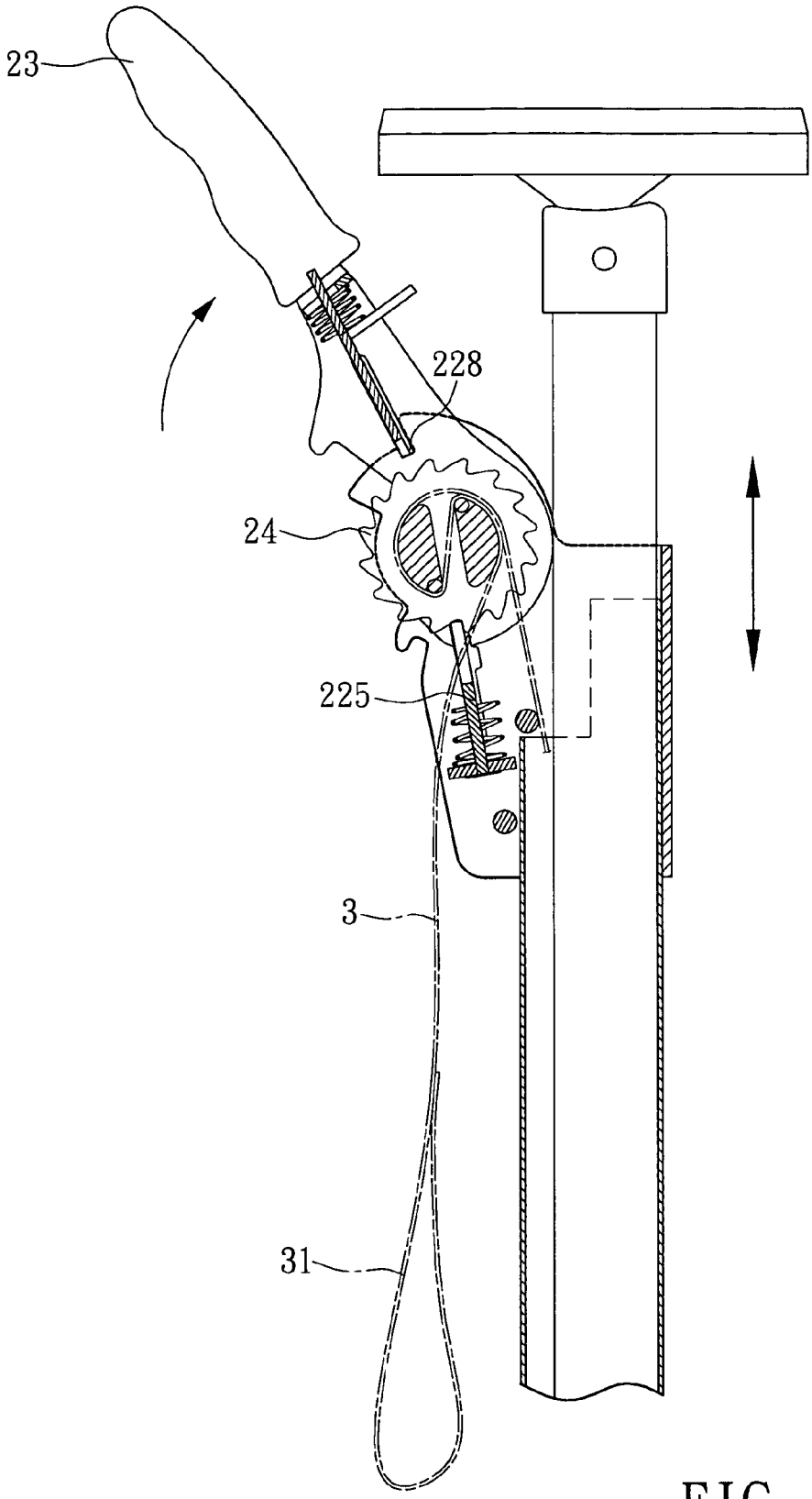
FIG. 11 shows the inner tube is freely moved relative to the outer tube when the second engaging plate is engaged with the notches for the embodiment of FIG. 8.
Figure 12:
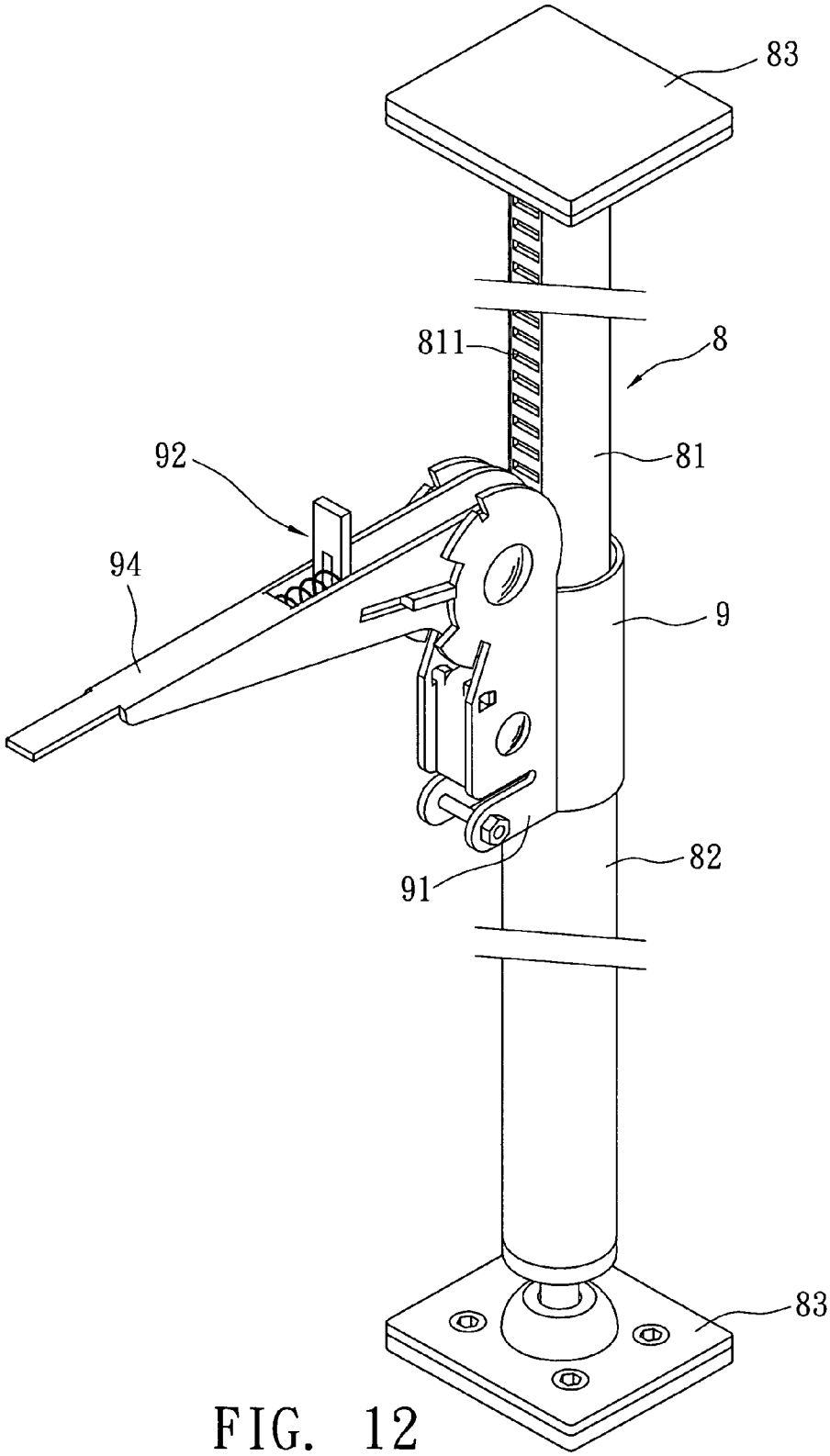
FIG. 12 PRIOR ART
FIG. 12 is a perspective view to show a conventional extension rod unit.
Figure 13:
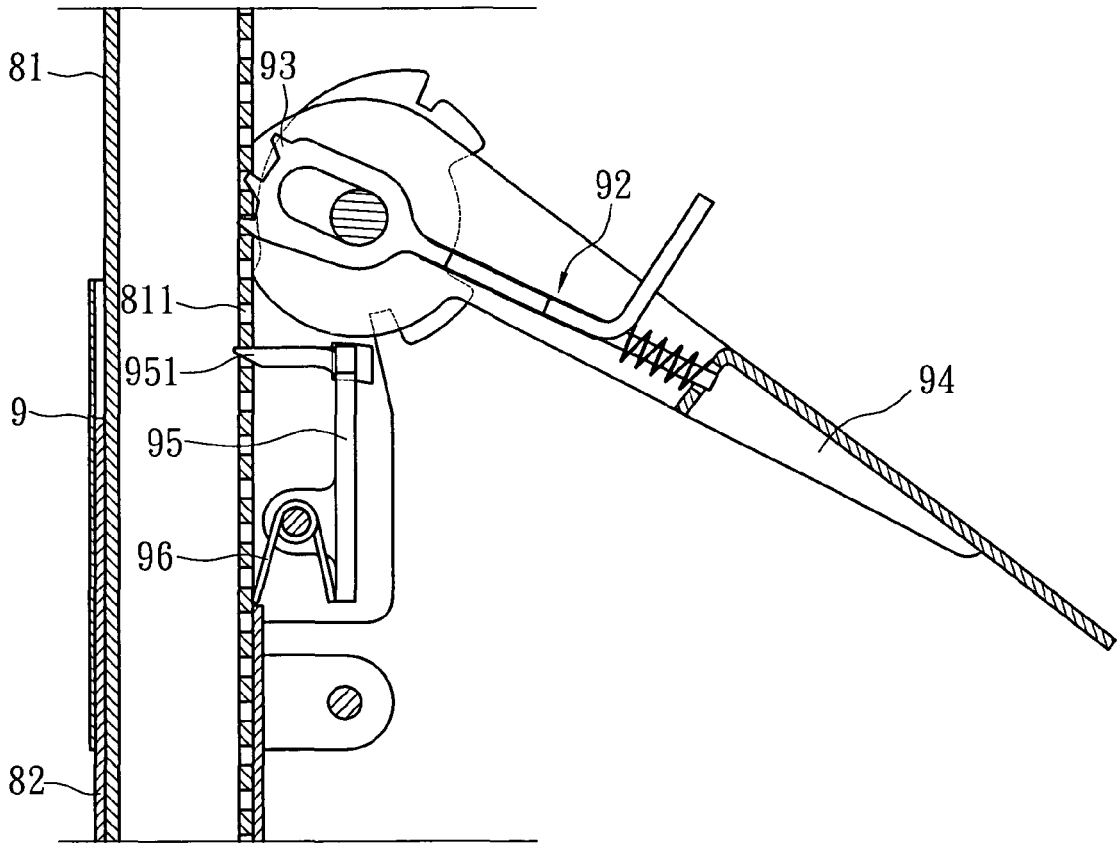
FIG. 13 PRIOR ART
FIG. 13 is a partial cross sectional view to show that the inner tube of the conventional extension rod unit moves upward by pivoting the lever.

As shown in FIG. 7, if the user wants to retract the inner tube 12 into the outer tube 11, the second engaging plate 232 is positioned in the notches 228 of the two first lugs 224 of the connection member 22. The first engaging plate 225 is disengaged from the ratchet gears 24 by the push parts 234 so that the first and second engaging plates 225, 232 both are disengaged from the ratchet gears 24. The inner tube 12 is freely moved relative to the outer tube 11.

The driving member 3 is between the shaft 21 and the second end of the inner tube 12, so that when the lever 23 is operated, the shaft 21 drives the driving member 3 which moves the inner tube 12. By this arrangement, the inner tube 12 can be micro-adjusted to eliminate the gaps between the boxes to be tied. The driving member includes a tension so as to absorb shaking force during transportation. The inner tube 12 does not include positioning holes so that the inner tube 12 can be applied with heat treatment to increase the structural strength thereof. Besides, the inner tube 12 is not supported by a single pawl as disclosed in the conventional extension rod unit, so that the inner tube 12 can have a longer life of use.

FIGS. 8 to 11 show a second embodiment of the present invention, wherein the ratchet gears 24 each have curved teeth which curve toward clockwise or counter clockwise. When extending the inner tube 12, the second engaging plate 232 of the lever 23 is engaged with the recesses 227, by pivoting the lever 23 downward, the driving member 3 moves the inner tube 12 to extend from the outer tube 11.

While we have shown and described the embodiment in accordance with the present invention, it should be clear to those skilled in the art that further embodiments may be made without departing from the scope of the present invention.

What is claimed is:

1. An extension rod unit comprising:

an outer tube and an inner tube which has a first end retractably inserted into an open top of the outer tube, a space defined between the outer and inner tubes, a fixing part located on the first end of the inner tube and located within the outer tube, two support boards connected to a second end of the inner tube and a lower end of the outer tube;

a ratchet unit connected to the open top of the outer tube and including a connection member, a shaft extending through the connection member and an end of a lever, the connection member including two side panels and each having a first lug extending therefrom, the lever having two second lugs and the shaft extending through the first and second lugs so as to pivotably connect the lever to the connection member, two ratchet gears located between two sets of first and second lugs, a slot defined axially through the shaft, a first engaging plate located in the connection member and biased by a first spring so as to be engaged with the ratchet gears, each of the two first lugs including a recess and a notch, the lever including a second engaging plate movably connected thereto and the second engaging plate biased by a second spring so as to be engaged with the ratchet gears, the second lugs each including a push part;

a driving member having a first end fixed to the fixing part and a second of the driving member extending through the slot of the shaft and located beyond the outer tube, and when the second engaging plate is positioned in the recesses of the two first lugs of the connection member, the first and second engaging plates both are engaged with the ratchet gears, the inner tube is moved in a direction away from the outer tube by pivoting the lever, the first engaging plate prevents the ratchet gears from rotating reversely, when the second engaging plate is positioned in the notches of the two first lugs of the connection member, the first engaging plate is disengaged from the ratchet gears by the push parts so that the first and second engaging plates both are disengaged from the ratchet gears, the inner tube is freely moved relative to the outer tube.

2. The unit as claimed in claim 1, wherein the driving member is an elongate strip, a steel rope, a fabric rope or a cable.

3. The unit as claimed in claim 1, wherein each of the side panels of the connection member includes multiple holes and bolts extend through the holes to connect the connection member to the outer tube.

4. The unit as claimed in claim 1, wherein the outer tube has a substantially circular cross section and the inner tube has a substantially semi-circular cross section.

5. The unit as claimed in claim 1, wherein the outer tube and the inner tube each have a substantially rectangular cross section.

6. The unit as claimed in claim 1, wherein the ratchet gears each have curved teeth which curve toward clockwise or counter clockwise.

* * * * *